US011845119B2

(12) United States Patent
Wendt et al.

(10) Patent No.: US 11,845,119 B2
(45) Date of Patent: Dec. 19, 2023

(54) WORKPIECE DRIVE AND DESCALING DEVICE HAVING A WORKPIECE DRIVE

(71) Applicants: Hauhinco Maschinenfabrik G. Hausherr, Jochums GmbH & Co. KG, Sprockhövel (DE); Wendt Maschinenbau GmbH & Co. KG, Georgsmarienhütte (DE)

(72) Inventors: Michael Wendt, Georgsmarienhütte (DE); Ralf Mogalle, Georgsmarienhütte (DE)

( * ) Notice: Subject to any disclaimer, the term of this patent is extended or adjusted under 35 U.S.C. 154(b) by 123 days.

(21) Appl. No.: 17/595,061

(22) PCT Filed: May 6, 2020

(86) PCT No.: PCT/EP2020/062626
§ 371 (c)(1),
(2) Date: Nov. 8, 2021

(87) PCT Pub. No.: WO2020/225327
PCT Pub. Date: Nov. 12, 2020

(65) Prior Publication Data

US 2022/0219214 A1 Jul. 14, 2022

(30) Foreign Application Priority Data

May 6, 2019 (DE) ..... 10 2019 111 723.2

(51) Int. Cl.
*B21B 45/04* (2006.01)
*B24C 1/08* (2006.01)
(Continued)

(52) U.S. Cl.
CPC ..... *B21B 45/04* (2013.01)

(58) Field of Classification Search
CPC ..... B21B 45/04; B24C 1/086; B24C 3/18; B24C 3/22; B05B 13/0654;
(Continued)

(56) References Cited

U.S. PATENT DOCUMENTS 5,584,747 A * 12/1996 Ikeda ..... B24C 9/003 221/277
2016/0136704 A1* 5/2016 Poloni ..... B08B 9/0321 134/8

FOREIGN PATENT DOCUMENTS

CN 201186303 Y 1/2009
CN 102764778 B 12/2014
(Continued)

OTHER PUBLICATIONS

International Search Report and Written Opinion of the International Searching Authority; Application No. PCT/EP2020/062626; Completed: Jul. 16, 2020; dated Aug. 26, 2020; 8 Pages.

*Primary Examiner* — Matthew Katcoff
*Assistant Examiner* — Mohammed S. Alawadi
(74) *Attorney, Agent, or Firm* — Patrick D. Duplessis

(57) ABSTRACT

A workpiece drive for rotating a circular workpiece in a descaling device has a carrier and at least three support roller modules. Each of the support roller modules has a bearing and a support roller for the circular workpiece. The support roller has a longitudinal axis, a lateral surface and a radius between the longitudinal axis and the lateral surface, and the radius decreases in a longitudinal direction along the longitudinal axis. The bearing supports the support roller rotatably around the longitudinal axis. Each of the support roller modules has a drive and the drive is designed to rotate the support roller around the longitudinal axis. The bearings are arranged on the carrier in such a way that the longitudinal axes have a point of intersection and lie in a plane perpen-
(Continued)

dicular to the earth gravity field vector and such that the longitudinal directions are directed towards the point of intersection.

11 Claims, 7 Drawing Sheets

(51) Int. Cl.
*B24C 3/18* (2006.01)
*B24C 3/22* (2006.01)
*B05B 13/06* (2006.01)
*B05B 13/02* (2006.01)

(58) Field of Classification Search
CPC ..... B05B 13/0228; Y10T 29/4533; Y10T 29/4544; Y10T 29/4511
USPC ..... 72/39
See application file for complete search history.

(56) References Cited

FOREIGN PATENT DOCUMENTS

| | | | | |
|---|---|---|---|---|
| EP | 2561960 A1 | 2/2013 | | |
| EP | 3165296 A1 * | 5/2017 | ..... | B21B 45/04 |

* cited by examiner

WORKPIECE DRIVE AND DESCALING DEVICE HAVING A WORKPIECE DRIVE

TECHNICAL FIELD

In one aspect, the invention relates to a workpiece drive for rotating a circular workpiece in a descaling device. The workpiece drive comprises a carrier. In another aspect, the invention relates to a descaling device for a circular workpiece. Here, the descaling device comprises a housing, said workpiece drive and a first scale washer. The first scale washer is located in the housing. Further, the housing is configured to accommodate a circular workpiece on the workpiece drive.

BACKGROUND

In any case, a circular workpiece has a first end face, a second end face, an outer lateral surface, and a circular outer contour, wherein the workpiece can be placed on the circular outer contour. The circular outer contour is an intersection between the outer lateral surface and the first end face. Often, a circular workpiece also has an inner lateral surface. The surfaces are covered with scale and usually the temperature is so high that it smolders. The high temperature is necessary for further processing of the workpiece. Circular workpieces have a mass of several kilograms to several tons. They are especially cylindrical and rotationally symmetrical workpieces, such as rings, wheel tires and discs.

A workpiece drive known from the prior art has a turntable with an axis of rotation. The turntable is arranged on the carrier and has a drive for rotating the turntable. A circular workpiece having an inner lateral surface is placed on the turntable with the first end face. To ensure that the circular workpiece placed on the turntable is concentric with the axis of rotation, the workpiece drive usually includes a guide. The guide is, for example, a mandrel that is arranged on the turntable concentrically to the axis of rotation. This mandrel centers the workpiece with respect to the axis of rotation when the workpiece is placed on the turntable by guiding the inner lateral surface.

In a prior art descaling device having such a workpiece drive, the workpiece drive rotates the turntable with a hot workpiece while the first descaler descales a surface of the workpiece. Descaling of a hot workpiece is usually done with water under high pressure, which is blasted onto the workpiece. Essentially, the scale on the workpiece is knocked off the surface by the momentum of the impinging water and rinsed off. Only free surfaces of the workpiece can be descaled. The housing surrounds the workpiece, the first descaling device, and the turntable so that, in any event, the water and knocked-off scale do not pose a hazard to the surroundings of the descaling device and at least a substantial portion of the liquid water and scale does not escape the housing.

Since the workpiece is seated with the first end face on the turntable and usually the guide covers another face of the workpiece, the workpiece must be turned over at least once for descaling from all faces. Concealed surfaces, such as the first end face concealed by the turntable, are not accessible to scale washers. Accordingly, not all surfaces of a workpiece, i.e., the first and second end faces, the inner lateral surface and the outer lateral surface can be descaled in a single work step, since a work step is completed by repositioning.

Repositioning a workpiece in the descaling device requires a suitable positioning device on the one hand and costs time on the other hand. Developing and manufacturing a repositioning device costs time and money. In addition, the workpiece continues to cool during the time it takes to reposition it. Cooling of the workpiece is undesirable, since only a sufficiently hot workpiece can be processed. In addition, the workpiece is also cooled by sitting on the turntable.

SUMMARY

An object of the present invention is to overcome or at least lessen the disadvantages set forth.

The object is achieved by a first workpiece drive. This workpiece drive has at least three support roller modules. Each of the support roller modules has a bearing and a support roller for a circular workpiece. The support roller has a longitudinal axis, a lateral surface and a radius between the longitudinal axis and the lateral surface. The radius decreases in a longitudinal direction along the longitudinal axis. The bearing supports the support roller for rotation around the longitudinal axis. Each of the support roller modules has a drive and the drive is designed to rotate the support roller around the longitudinal axis.

The bearings are arranged on the support such that the longitudinal axes have a point of intersection, such that the longitudinal directions are directed toward the point of intersection, and such that the lateral surfaces for a workpiece placed on the support rollers form a tapered receptacle with a receptacle axis, wherein the receptacle axis is oriented substantially parallel to the earth gravity field vector.

The workpiece drive is designed for placing a circular workpiece on the at least three support rollers. Each of the drives includes a motor for rotating the support rollers. The drives are designed to rotate the support rollers at an equal speed in a same direction.

The conical receptacle formed by the lateral surfaces of the support rollers for a workpiece placed on the support rollers is a geometric surface which is determined by the lateral surfaces of the support rollers. The surface has a center point and rises outward, i.e., opposite the longitudinal direction, in opposition to the earth gravity field vector. The shape of the lateral surfaces of the support rollers, in conjunction with the orientation and arrangement of the support rollers relative to one another, initially causes a circular workpiece placed on the support rollers to be in contact with the support rollers only with its circular outer contour. Thus, a contact area between a circular workpiece and the workpiece drive is reduced compared to the prior art, which also reduces cooling of the workpiece. Further, if the workpiece has been placed eccentrically with respect to a centering axis passing through the intersection point and parallel to the earth gravity field vector, it is made to be centered with respect to the centering axis as it is rotated by the rotating support rollers so that it eventually rotates concentrically around the centering axis. Thus, a guide as in the prior art is no longer necessary. Usually, the center point of the tapered support lies on the centering axis.

In one design of the workpiece drive, it is provided that a receptacle opening angle of the conical receptacle is greater than 160° and less than 180°.

The object is also achieved by a second workpiece drive. This workpiece drive has at least three support roller modules. Each of the support roller modules has a bearing and a support roller for a circular workpiece. The support roller has a longitudinal axis, a lateral surface and a radius between the longitudinal axis and the lateral surface. The radius decreases in a longitudinal direction along the longitudinal axis. The bearing supports the support roller for rotation around the longitudinal axis. Each of the support roller modules has a drive, and the drive is designed to rotate the support roller around the longitudinal axis.

The bearings are arranged on the support such that the longitudinal axes have a point of intersection and lie in a plane perpendicular to the earth gravity field vector and such that the longitudinal directions are directed to the point of intersection.

The explanations for the first workpiece drive apply accordingly to the second workpiece drive.

Designs of the first and second workpiece drives are described in the following.

In one design of the workpiece drive, it is provided that the bearings are arranged on the carrier in such a way that the longitudinal axes are radially symmetrical. Radial symmetry is given when angles between each two adjacent longitudinal axes are equal. The radially symmetrical arrangement of the longitudinal axes causes the centering of a circular workpiece placed eccentrically on the support rollers with the least number of revolutions of the workpiece by the workpiece drive.

In a further design, it is provided that at least one of the lateral surfaces is tapered. When the lateral surface of a support roller is tapered, the support roller is a straight taper or truncated taper. Preferably, the cone or frustum has a cone opening angle greater than 0° and less than 60°. The cone opening angle should be selected in such a way that the conical shape of the conical receptacle is retained. For very small cone opening angles in the above-mentioned range, the support rollers are practically cylinders. With a cone or frustum as a support roller, the radius decreases in the longitudinal direction along the longitudinal axis in proportion to a distance along the longitudinal axis. Cones or frusta are suitable as support rollers because they are easier to manufacture than other lateral surfaces with radii that do not decrease in proportion to a distance along the longitudinal axis.

The bearing of a support roller module can be arranged on an inner side and/or outer side of the workpiece drive. The inner side is on the side of the support roller of the support roller module on which the intersection of the longitudinal axes of the support rollers is located, whereas the outer side is on the other side of the support roller.

It is provided in a further design that, at least in one of the support roller modules, the bearing is only on one side of the support roller with respect to the longitudinal axis. This one-sided bearing of a support roller either on the inner or outer side has the effect that the support roller is easier to remove and install than in the case of a bearing on both sides. Since support rollers wear out with use, the single-sided bearing arrangement reduces maintenance costs and downtime.

In a further development of the above embodiment, it is provided that the support roller is arranged between the bearing and the point of intersection. Thus, the bearing of the support roller is on the outside. By arranging the bearing on the outside, the bearing is more easily accessible than if it were on the inside. Thus, maintenance of the bearing arrangement is simplified. Preferably, all bearings are on the outside. This is because the inside is then free. The free inner side allows free access to the inner lateral surface of a circular workpiece placed on the workpiece drive.

The object is also achieved by a descaling device according to patent claim 8. This descaling device has one of the workpiece drives described above. It further comprises a second and a third scale washer in addition to the first one. The first scale washer is arranged on the support for spraying the outer lateral surface, the second scale washer is arranged on the support between two adjacent support rollers for spraying the first end face, and the third scale washer is arranged on the support for spraying the second end face with a liquid medium, preferably water. The support rollers, the first, second and third scale washers are arranged in the housing so that the medium and chipped scale in any case do not pose a hazard to the surroundings of the descaling device and at least a substantial part of the liquid medium and scale does not escape from the housing.

A circular workpiece, which is exposed with its circular outer contour in the housing on the support rollers, is rotated around the centering axis by the workpiece drive during operation of the descaling device and, in comparison with the prior art, is not only sprayed on one surface, but on at least three surfaces, namely the outer surface, the first end face and the second end face, with a medium under high pressure for descaling. Thus, not one surface but three surfaces are descaled in one work step. In contrast to the prior art, the workpiece drive enables, in particular, the arrangement of a scale washer for descaling the first end face.

In one design of the descaling device, it is provided that the descaling device comprises a fourth scale washer, that the fourth scale washer is arranged on the carrier for spraying the inner lateral surface with the medium. The four scale washers allow descaling of all surfaces of a circular workpiece in a single step. It is no longer necessary to reposition the workpiece in order to descale a hidden surface of the workpiece. Consequently, no repositioning device is required, and the time required for descaling is reduced compared to the prior art. The reduced time requirement results in less cooling of the workpiece.

In a further development of the above design, it is provided that the fourth scale washer is designed as a lance. The design of the fourth scale washer as a lance enables the scale washer to be easily moved into and out of the inner lateral surface of a circular workpiece arranged on the support rollers in the housing. The ability to move the fourth scale washer in and out of the inner lateral surface makes it easier to place a circular workpiece on the support rollers and to remove it.

In a particularly preferred design, it is provided that the bearings of the support roller modules are on the outside. Then the inner side is free, which also allows access to the inner lateral surface of a circular workpiece. This design also lends itself to the use of a fourth scale washer designed as a lance, since this can be moved unhindered through the inner lateral surface.

BRIEF DESCRIPTION OF THE DRAWINGS

In detail, there is a plurality of possibilities for designing and further developing the workpiece drive and the descaling device. For this, reference is made to the following description of a preferred embodiment of a descaling device and of two embodiments of a workpiece drive in conjunction with the drawings.

DETAILED DESCRIPTION

Figure 1:
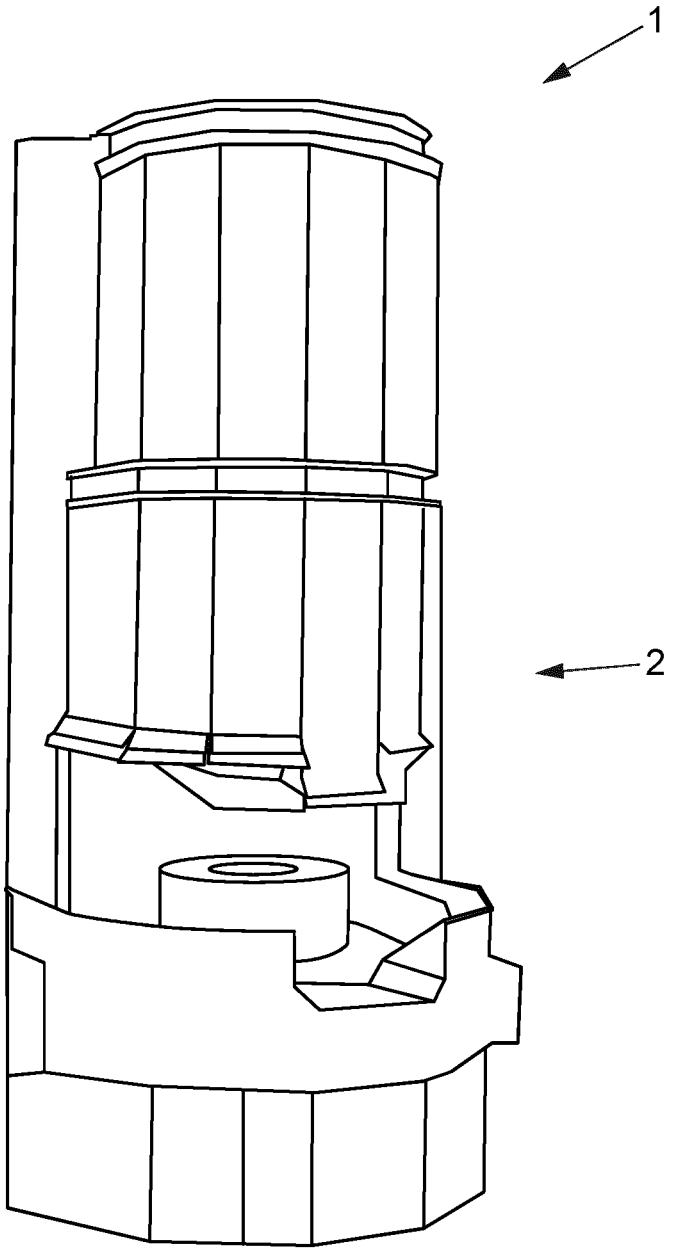
FIG. 1 illustrates an embodiment of a descaling device in a view with a housing with a first embodiment of a workpiece drive.
Figure 2:
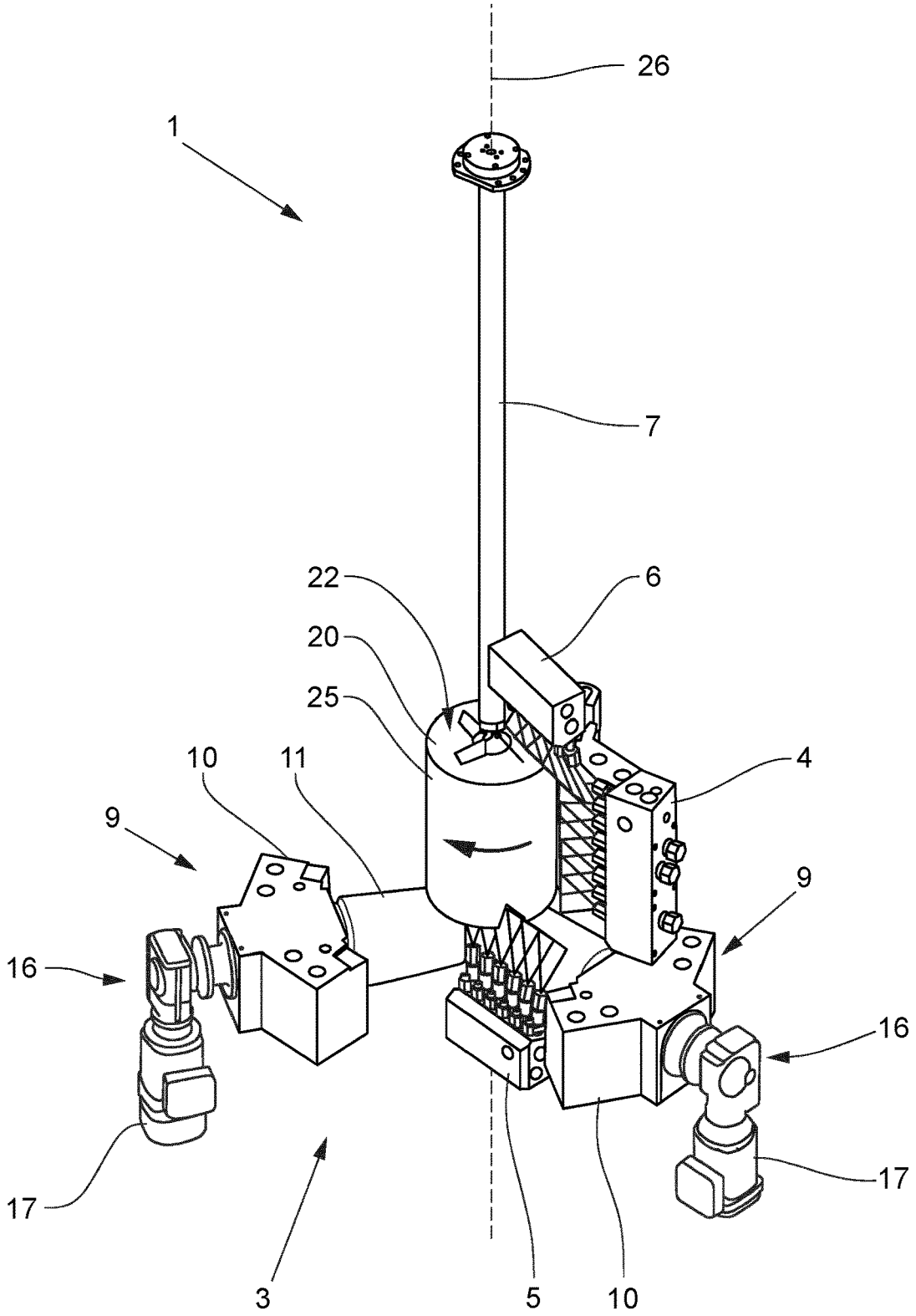
FIG. 2 illustrates the embodiment in a view without a housing.
Figure 3:
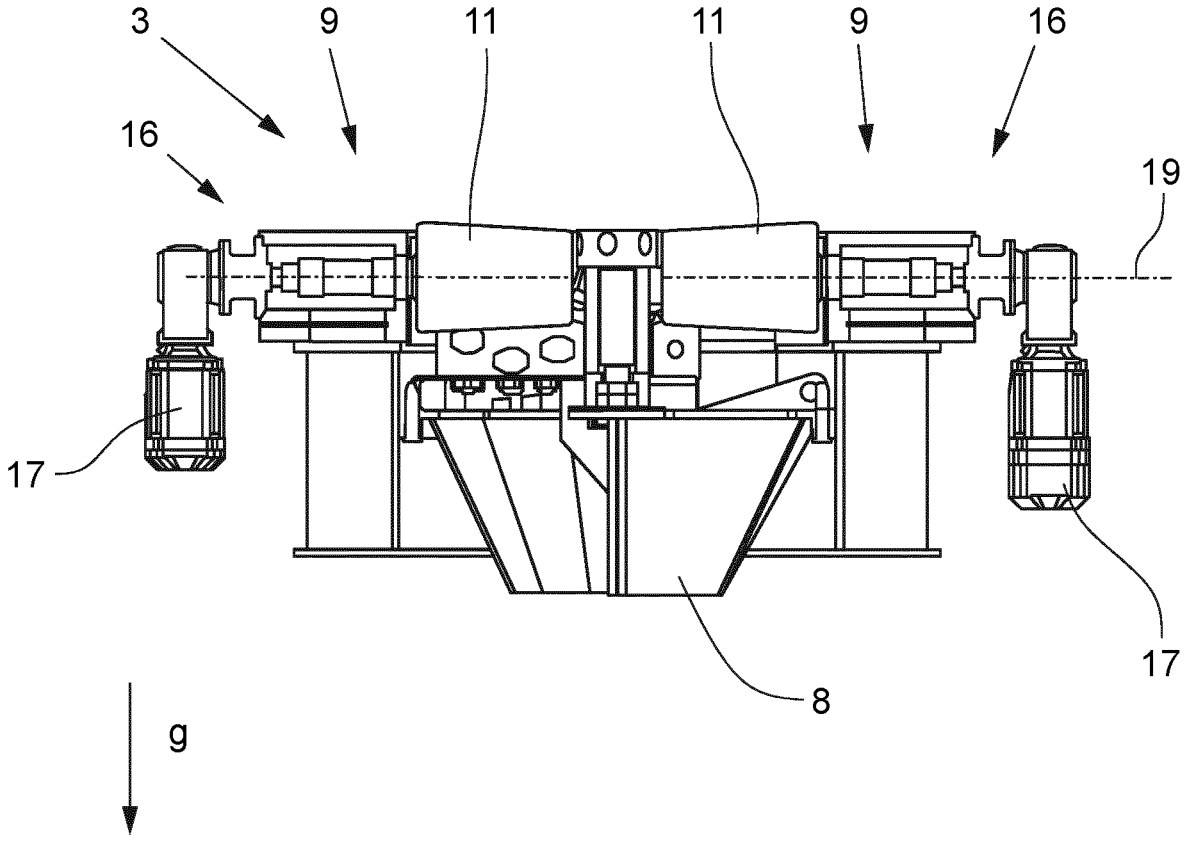
FIG. 3 illustrates the embodiment in a cut front view.
Figure 4:
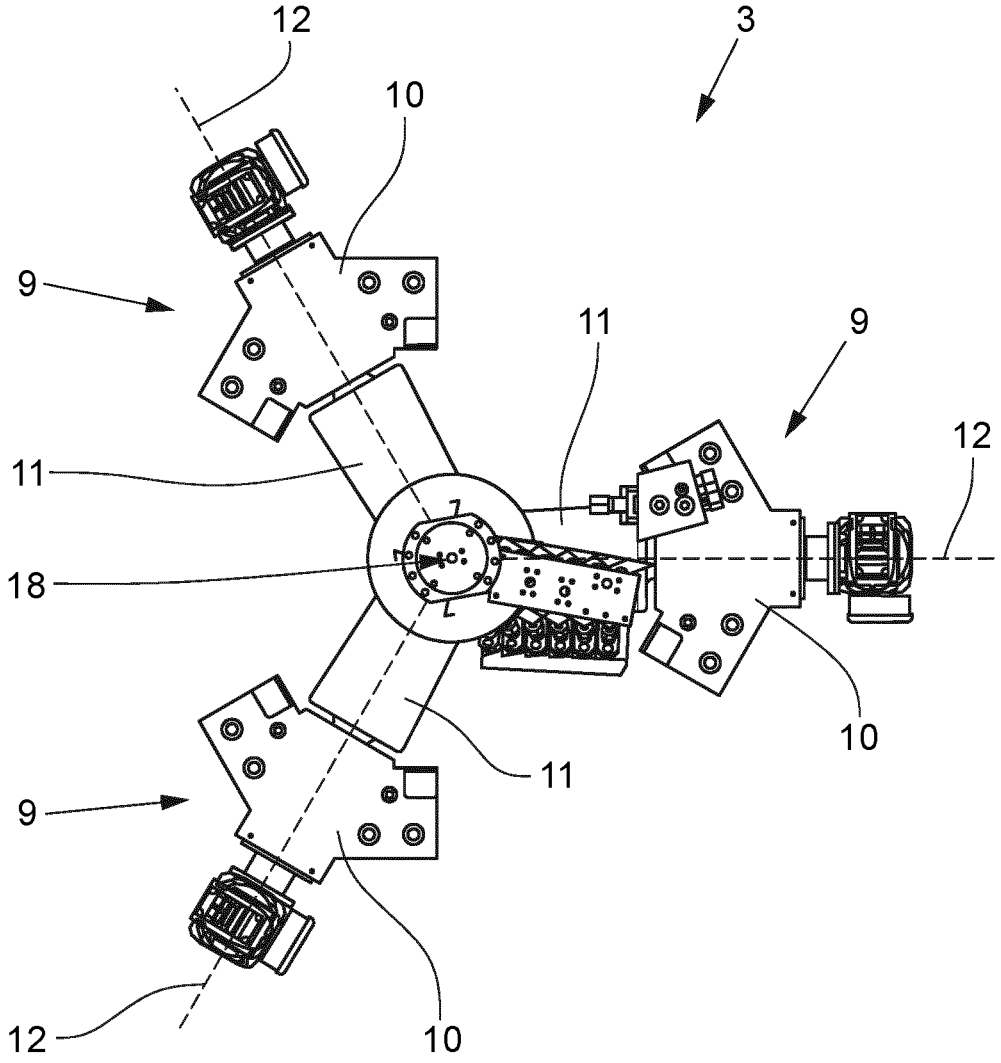
FIG. 4 illustrates the embodiment in a top view.
Figure 5:
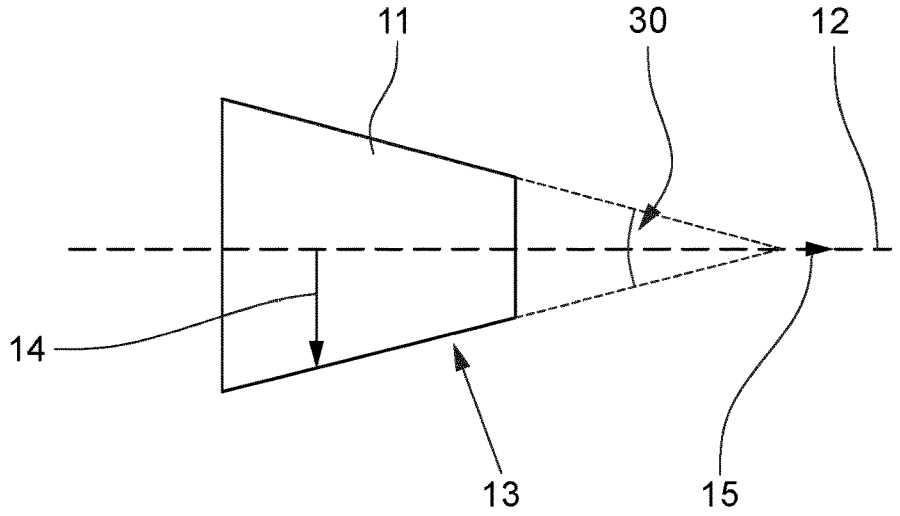
FIG. 5 illustrates a support roller of the embodiment.

FIGS. 1 to 5 show an embodiment of a descaling device 1 for circular workpieces. It has a housing 2, a first embodiment of a workpiece drive 3 for rotating a circular workpiece, a first scale washer 4, a second scale washer 5, a third scale washer 6, and a fourth scale washer 7. The fourth scale washer 7 is designed as a lance.

The workpiece drive 3 has a carrier 8 and three support roller modules 9. Each of the support roller modules 9 has a bearing 10 and a support roller 11 for a circular workpiece. The support roller 11 has a longitudinal axis 12, a lateral surface 13, and a radius 14 between the longitudinal axis 12 and the lateral surface 13. The radius 14 decreases in a longitudinal direction 15 along the longitudinal axis 12. The lateral surface 13 of the support roller 11 is tapered, which is why the support roller 11 is a frustum. Consequently, the radius 14 decreases in a longitudinal direction 15 along the longitudinal axis 12 in proportion to a distance along the longitudinal axis 12. A cone opening angle 30 of the support rollers 11 is 15°. Frusta as support rollers 11 are advantageous, since they are easy to manufacture. The bearing 10 supports the support roller 11 rotatably around the longitudinal axis 12. Each of the support roller modules 9 has a drive 16 with a motor 17, and the drive 16 is designed to rotate the support roller 11 around the longitudinal axis 12. The drives 16 are designed to rotate the support rollers 11 at an equal speed in an equal direction. The bearings 9 are arranged on the support 8 in such a way that the longitudinal axes 12 have a point of intersection 18, lie in a plane 19 perpendicular to the earth gravity field vector g and are radially symmetrical, and such that the longitudinal directions 15 are directed towards the point of intersection 18.

The supports 10 are arranged on only one side of the support rollers 11 with respect to the longitudinal axes 12, namely the support rollers 11 are arranged between the supports 10 and the intersection point 18. Thus, the bearings 10 are on the outside and not on the inside. The inner side is on the side of the support rollers 11 on which the intersection point 18 of the longitudinal axes 12 is located, whereas the outer side is on the other side of the support rollers 11. That the support rollers 11 are mounted only on one side 10 on the outside means that the support rollers 11 are easy to remove and install. Since support rollers 11 wear with use, having bearings 10 on one side reduces maintenance costs and downtime. By locating the bearing arrangements 10 on the outside, the bearing arrangements 10 are more easily accessible than if they were on the inside. Thus, maintenance of the bearing arrangements 10 is simplified.

Figure 6:
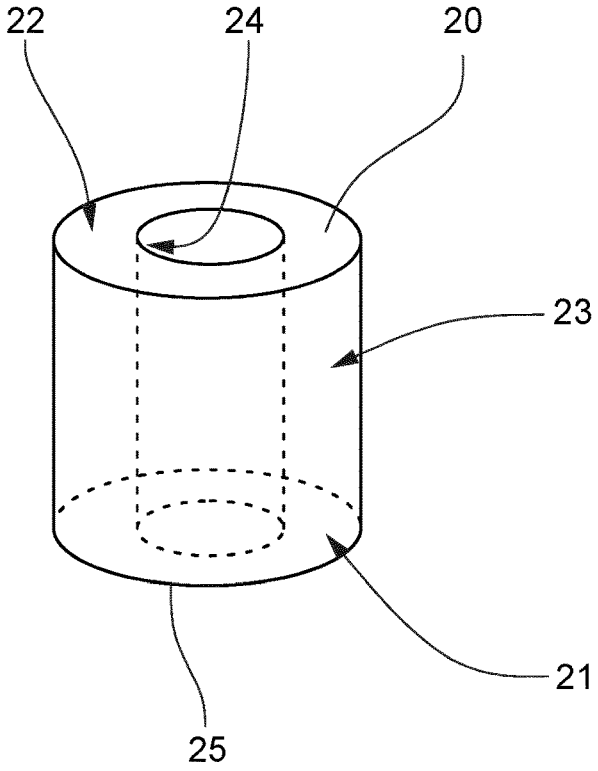
FIG. 6 illustrates an embodiment of a circular workpiece.

FIG. 6 shows a circular workpiece 20 in the form of a rotationally symmetrical workpiece for the workpiece drive 3 and for the descaling device 1. It has a first end face 21, a second end face 22, an outer lateral surface 23, an inner lateral surface 24 and a circular outer contour 25. The circular outer contour 25 is an intersection between the outer lateral surface 23 and the first end face 21. The workpiece is red-hot and all surfaces are covered with scale.

The shape of the lateral surfaces 13 of the support rollers 11, in conjunction with the orientation and arrangement of the support rollers 11 relative to one another, has the effect, firstly, that the circular workpiece 20, which is placed on the support rollers 11 and is red-hot and covered with scale on all surfaces, is in contact with the support rollers 11 only with its circular outer contour 25.

Thus, a contact area between the circular workpiece 20 and the workpiece drive 3 is reduced compared to the prior art, whereby cooling of the workpiece 20 is also reduced. Secondly, if the workpiece 20 has previously been placed eccentrically with respect to a centering axis 26 passing through the intersection 18 and perpendicular to the plane 19, the workpiece 20 is caused to center with respect to the centering axis 26 as it is rotated by the rotating support rollers 11 so that it finally rotates concentrically around the centering axis 26. The radially symmetrical arrangement of the longitudinal axes 12 causes the circular workpiece 20, which has been placed eccentrically on the support rollers 11, to be centered with the least number of revolutions of the workpiece 20 by the workpiece drive 3.

The first scale washer 4 is arranged on the support roller 8 for spraying the outer lateral surface 23, the second scale washer 5 is arranged on the support roller 8 between two adjacent support rollers 11 for spraying the first end face 21, the third scale washer 6 is arranged on the support roller 8 for spraying the second end face 22, and the fourth scale washer 7 is arranged on the support roller 8 for spraying the inner lateral surface 24 with water under high pressure. The four scale washers 4, 5, 6, 7 enable descaling of all surfaces 21, 22, 23, 24 of the circular workpiece 20 in a single operation. It is no longer necessary to reposition the workpiece 20, which reduces the time required for descaling compared to the prior art. The reduced time requirement results in less cooling of the workpiece.

The support rollers 11, and the four scale washers 4, 5, 6, 7 are arranged in the housing 2, so that the water and chipped, in any case, do not pose a danger to the surroundings of the descaling device 1 and at least a substantial part of the water and scale does not escape from the housing 2.

The design of the fourth scale washer 7 as a lance makes it easy to move the fourth scale washer 7 into and out of the inner lateral surface 24 of the circular workpiece 20 arranged on the support rollers 11 in the housing 2. The ability to move the fourth scale washer 7 into and out of the inner lateral surface 24 makes it easier to place the circular workpiece 20 on the support rollers 11 and to remove it.

Figure 7:
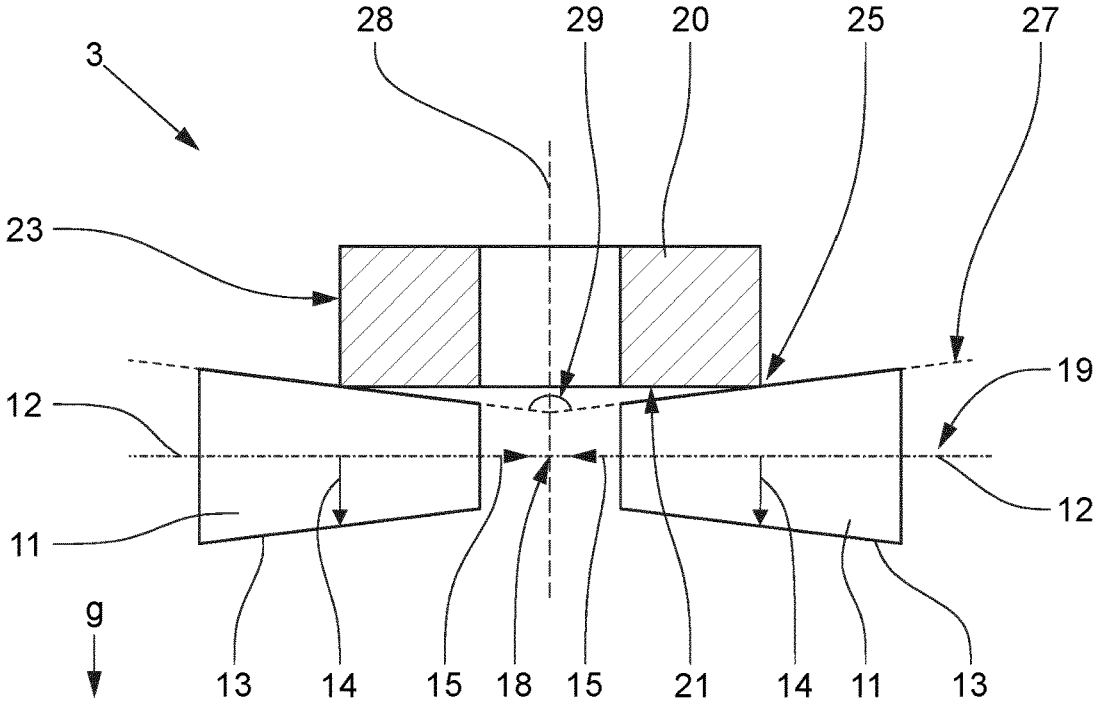
FIG. 7 illustrates a cut front view of the workpiece drive.

FIG. 7 shows the workpiece drive 3 in a cutaway front view. In this, two of the three support rollers 11 and a workpiece 20 placed on the support rollers 11 are visible. The outer contour 25 of the workpiece 20 is in contact with the lateral surfaces 13 of the support rollers 11. The longitudinal axes 12 have the intersection point 18 and the longitudinal directions 15 are directed to the intersection point 18. The longitudinal axes 12 lie in the plane 19. The radii 14 decrease in the longitudinal directions 15 along the longitudinal axes 12. A conical receptacle 27 having a receiving axis 28 is formed by the lateral surfaces 13 for the workpiece 20. The tapered receptacle 27 is a geometric surface 31 which is determined by the lateral surfaces 13 of the support rollers 11. The surface 31 has a center point 32 and rises outwardly, i.e., opposite the longitudinal directions 15, in opposition to the earth gravity field vector g. The receptacle axis 28 is substantially parallel to the earth gravity field vector g. Usually, and also here, the receptacle axis 28 coincides with the centering axis 26.

Figure 8:
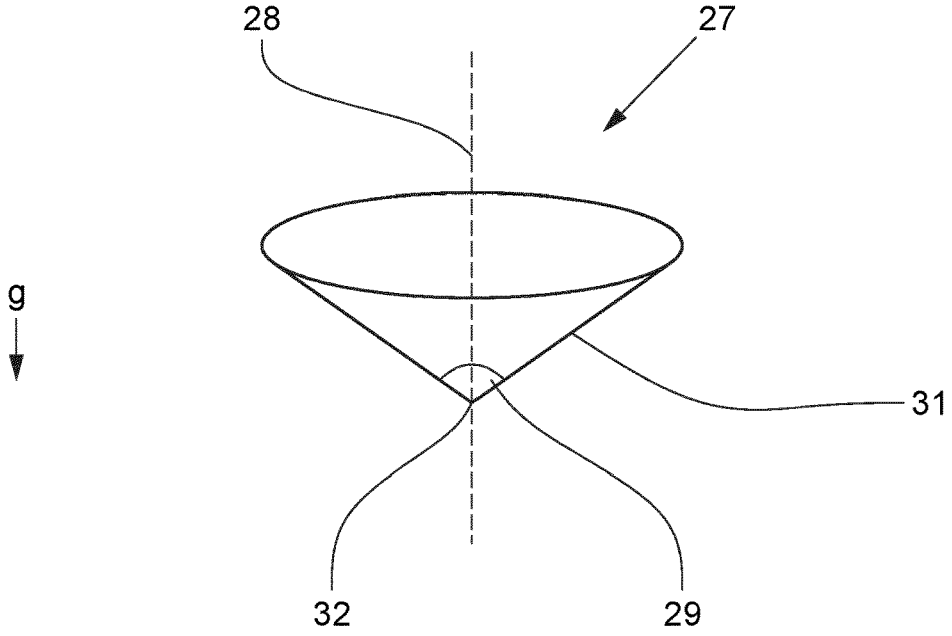
FIG. 8 illustrates a conical receptacle of the workpiece drive.

FIG. 8 shows the conical receptacle 27 in a perspective view from obliquely above. The receptacle opening angle is 170° and is shown exaggerated for better recognizability.

Figure 9:
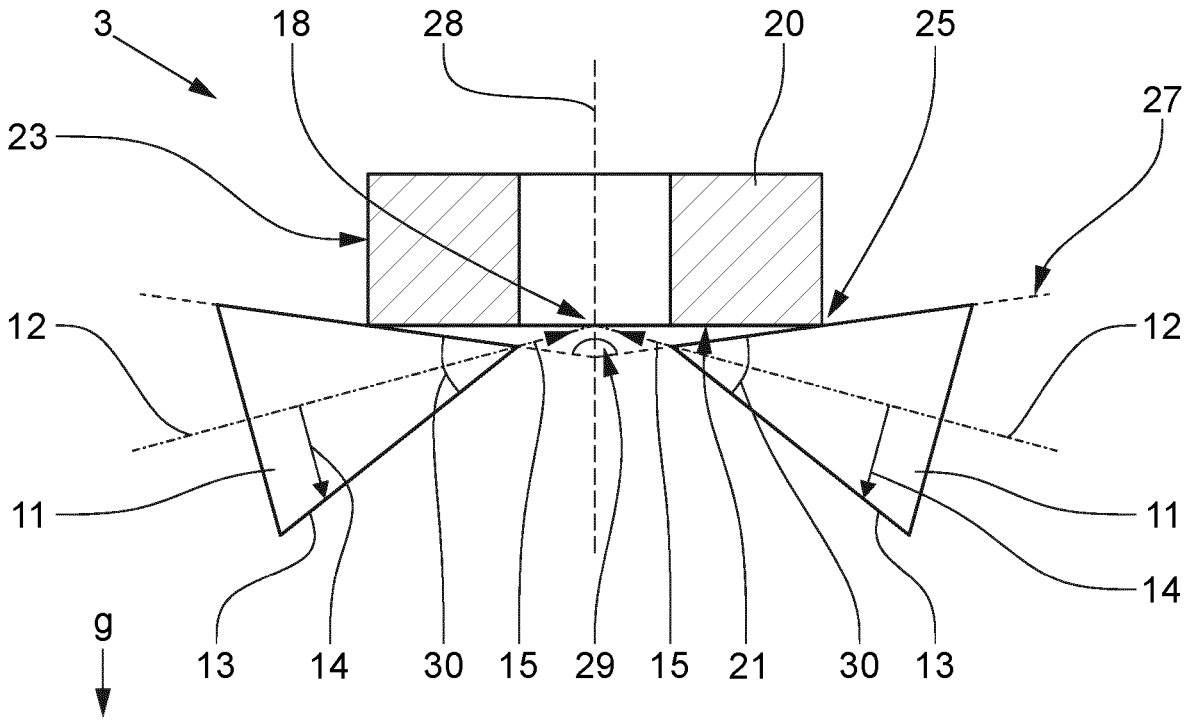
FIG. 9 illustrates a cut front view of a second embodiment of a workpiece drive.

FIG. 9 shows a second embodiment of a workpiece drive 3 of the descaling device 1 for circular workpieces 20 in a cut front view. With the exception of the following, the explanations with respect to the first embodiment also apply to the second embodiment. In FIG. 9, two of the three support rollers 11 and a workpiece 20 placed on the support rollers 11 are visible. The outer contour 25 of the workpiece 20 is in contact with the lateral surfaces 13 of the support rollers 11. The longitudinal axes 12 have the intersection point 18 and the longitudinal directions 15 are directed towards the intersection point 18. In contrast to the first embodiment, the longitudinal axes 12 do not lie in a plane in the second embodiment. The radii 14 decrease in the longitudinal directions 15 along the longitudinal axes 12. A conical receptacle 27 with a receptacle axis 28 is also formed here by the lateral surfaces 13 for the workpiece 20. The conical receptacle 27 is a geometric surface 31, which is determined by the lateral surfaces 13 of the support rollers 11. The surface 31 has a center point 32 and rises outwardly, i.e., opposite the longitudinal directions 15, in opposition to the earth gravity field vector g. The receptacle axis 28 is substantially parallel to the earth gravity field vector g. Usually, as here, the receptacle axis 28 coincides with the centering axis 26.

The invention claimed is:

1. A workpiece drive for rotating a circular workpiece in a descaling device, comprising:

a carrier;

at least three support roller modules;

wherein each of the support roller modules has a bearing and a support roller for the circular workpiece;

wherein the support roller has a longitudinal axis, a lateral surface and a radius between the longitudinal axis and the lateral surface, and the radius decreases in a longitudinal direction along the longitudinal axis;

wherein the bearing supports the support roller rotatably around the longitudinal axis;

wherein each of the support roller modules has a drive and the drive is designed to rotate the support roller around the longitudinal axis;

wherein the bearings are arranged on the carrier in such a way that the longitudinal axes have a point of intersection, such that the longitudinal directions are directed towards the point of intersection, and such that the lateral surfaces of the support rollers form a conical receptacle for the circular workpiece, the conical receptacle having a receptacle axis; and wherein the receptacle axis is oriented essentially parallel to the earth gravity field vector.

2. The workpiece drive according to claim 1, wherein a receptacle opening angle of the conical receptacle is greater than 160° and less than 180°.

3. The workpiece drive according to claim 1, wherein the bearings are arranged on the carrier in such a way that the longitudinal axes are radially symmetrical.

4. The workpiece drive according to claim 1, wherein at least one of the lateral surfaces is conical.

5. The workpiece drive according to claim 4, wherein at least one of the lateral surfaces has a cone opening angle greater than 0° and less than 60°.

6. The workpiece drive according to claim 1, wherein, at least in one of the support roller modules, the bearing is only on one side of the support roller with respect to the longitudinal axis.

7. The workpiece drive according to claim 6, wherein the support roller is arranged between the bearing and the point of intersection.

8. A workpiece drive for rotating a circular workpiece in a descaling device, comprising:

a carrier;

at least three support roller modules;

wherein each of the support roller modules has a bearing and a support roller for the circular workpiece;

wherein the support roller has a longitudinal axis, a lateral surface and a radius between the longitudinal axis and the lateral surface, and the radius decreases in a longitudinal direction along the longitudinal axis;

wherein the bearing supports the support roller rotatably around the longitudinal axis;

wherein each of the support roller modules has a drive and the drive is designed to rotate the support roller around the longitudinal axis; and wherein the bearings are arranged on the carrier in such a way that the longitudinal axes have a point of intersection and lie in a plane perpendicular to the earth gravity field vector and such that the longitudinal directions are directed towards the point of intersection.

9. A descaling device for a circular workpiece, comprising:

a housing;

a workpiece drive for rotating the circular workpiece; and a first scale washer;

wherein the first scale washer is arranged in the housing;

wherein the housing is formed for receiving the circular workpiece with a first end face, a second end face, an outer lateral surface and an inner lateral surface on the workpiece drive;

wherein the workpiece drive includes:

a carrier;

at least three support roller modules;

wherein each of the support roller modules has a bearing and a support roller for the circular workpiece;

wherein the support roller has a longitudinal axis, a lateral surface and a radius between the longitudinal axis and the lateral surface, and the radius decreases in a longitudinal direction along the longitudinal axis;

wherein the bearing supports the support roller rotatably around the longitudinal axis;

wherein each of the support roller modules has a drive and the drive is designed to rotate the support roller around the longitudinal axis;

wherein the bearings are arranged on the carrier in such a way that the longitudinal axes have a point of intersection, such that the longitudinal directions are directed towards the point of intersection, and such that the lateral surfaces of the support rollers form a conical receptacle for the circular workpiece, the conical receptacle having a receptacle axis; and wherein the receptacle axis is oriented essentially parallel to the earth gravity field vector;

wherein the descaling device has a second scale washer and a third scale washer;

wherein the first scale washer is arranged on the carrier for spraying the outer lateral surface, the second scale washer is arranged on the carrier between two adjacent support rollers for spraying the first end face, and the third scale washer is arranged on the carrier for spraying the second end face with a liquid medium; and wherein the support rollers, the second scale washer and the third scale washer are arranged in the housing.

10. The descaling device according to claim 9, wherein the descaling device includes a fourth scale washer, and the fourth scale washer is arranged on the carrier for spraying the inner lateral surface with the medium.

11. The descaling device according to claim 10, wherein the fourth scale washer is designed as a lance.

* * * * *